US008573818B2

(12) United States Patent
Tu et al.

(10) Patent No.: US 8,573,818 B2
(45) Date of Patent: Nov. 5, 2013

(54) LUMINAIRE WITH ROTATING AND REMOVABLE DOOR

(75) Inventors: Chin-Wang Tu, Cupertino, CA (US); Shih Chang Wang, Chung Ho (TW); Pin-Hao Hsu, Yang Mei (TW)

(73) Assignee: Leotek Electronics Corporation, Lung-Tan, Tao-Yuan County (TW)

( * ) Notice: Subject to any disclaimer, the term of this patent is extended or adjusted under 35 U.S.C. 154(b) by 352 days.

(21) Appl. No.: 13/019,283

(22) Filed: Feb. 1, 2011

(65) Prior Publication Data

US 2011/0188256 A1 Aug. 4, 2011

Related U.S. Application Data

(60) Provisional application No. 61/300,767, filed on Feb. 2, 2010.

(51) Int. Cl.
*F21V 17/00* (2006.01)

(52) U.S. Cl.
USPC ..... 362/375; 362/281; 362/433; 362/267; 362/431

(58) Field of Classification Search
USPC ..... 362/375, 281, 431, 433, 267
See application file for complete search history.

(56) References Cited

U.S. PATENT DOCUMENTS

| | | | |
|---|---|---|---|
| 3,983,387 | A | 9/1976 | Van Steenhoven et al. |
| 4,379,321 | A | 4/1983 | Plemmons et al. |
| 5,351,174 | A | 9/1994 | Ewing |
| 5,615,259 | A | 3/1997 | Gilbert |
| 6,419,378 | B1 | 7/2002 | Wedell et al. |

OTHER PUBLICATIONS

International Search Report and Written Opinion, dated Apr. 12, 2011 which issued in corresponding PCT application PCT/US2011/023487, 6 pgs.

*Primary Examiner* — Anabel Ton
(74) *Attorney, Agent, or Firm* — DLA Piper LLP (US)

(57) ABSTRACT

A luminaire including a housing with a service compartment that is accessible through an opening in the housing, a light source, electrical components disposed in the service compartment for powering and operating the light source, and a door rotatably connected to the housing for rotation between a closed position where the door covers the opening and an open position where the door does not cover the opening. The rotatable connection includes an asymmetric pin extending from the door and a cavity formed in the housing having a hinge opening of width W. The asymmetric pin has a cross sectional thickness t and a cross sectional height h. Width W is less than height h and greater than thickness t, such that the pin is removable through the hinge opening when the door is in a removal position where the pin thickness t is aligned to the hinge opening width W.

16 Claims, 6 Drawing Sheets

LUMINAIRE WITH ROTATING AND REMOVABLE DOOR

RELATED APPLICATIONS

This application claims the benefit of U.S. Provisional Application No. 61/300,767, filed Feb. 2, 2010, and which is incorporated herein by reference.

FIELD OF THE INVENTION

The present invention relates to door hinges, and in particular a door hinge design that allows for the selective removal of the door from its frame while preventing accidental removal.

BACKGROUND OF THE INVENTION

Conventional street luminaires mounted high overhead are preferably serviceable from underneath where it is easiest to access them from the street. Service access within the luminaire housing would include access to the light source itself as well as the service compartment containing the supporting electrical components that power and operate the light source. The service compartment is typically sealed, and accessible through a removable door. Both the light source and the removable door face downwardly, so that service personnel standing on a ladder or lift basket can install and later service the light source and supporting electrical components while positioned underneath the luminaire.

There are several possible configurations for removably attaching the service compartment door to the housing. The door could be hinged to the housing, so that once unlatched, the door would swing down under the force of gravity to expose the service compartment. This configuration is ideal for minor work because it provides quick and simple access to the service compartment. The only tool needed would be one to operate the latch, and the latch could be configured to operate by hand which would mean no tools would be necessary to operate the door. However, for extensive work, the door hanging down from the housing could impede work, and increase the risk of the worker damaging the door by bumping into it. Additionally, the door could fall off if the hanging mechanism is not well designed or the open door is subjected to excessive force.

Alternately, the door could be entirely removable from the housing, whereby removing securing screws or bolts would allow the door to separate completely from the housing. The complete removal of the door would take longer than simply rotating it open with a hinge, and is more cumbersome because the worker needs to carefully collect the door and any securing screws/bolts as they fall away from the housing. However, once the door is removed, there would be unimpeded access to the service compartment. Once the servicing is complete, the door would have to be reattached. Due the complexity of this configuration it would not be ideal for minor servicing as the removal and replacement of the door could take more time than the servicing itself.

There is a need for a luminaire service compartment door design that allows easy access to the service compartment without completely removing the door, but additionally allowing for the convenient removal of the door in those situations where unimpeded access is necessitated. Moreover, it is desired to have the capability of removing the door without the need for tools, yet not have the door precariously attached thus risking it falling off during servicing under the force of gravity.

BRIEF SUMMARY OF THE INVENTION

The aforementioned problems and needs are addressed by a luminaire that includes a housing with a service compartment therein that is accessible through an opening in the housing, a light source at least partially disposed in the housing for producing a light output, electrical components disposed in the service compartment for powering and operating the light source, and a door that is rotatably connected via a hinge assembly to the housing for rotation between a closed position where the door covers the opening and an open position where the door does not cover the opening. The hinge assembly includes, an asymmetric pin extending from one of the housing and the door, a cavity formed in the other of the housing and the door having a hinge opening of width W, wherein the asymmetric pin has a cross sectional thickness t in one direction and a cross sectional height h in a direction orthogonal to the one direction, and wherein width W is less than height h and greater than thickness t such that the pin is removable from the cavity through the hinge opening when the door is in a removal position where the pin thickness t is aligned to the hinge opening width W.

Alternatively, a luminaire includes a housing with a service compartment therein that is accessible through an opening in the housing, a light source at least partially disposed in the housing for producing a light output, a door that is rotatably connected via a hinge assembly to the housing for rotation between a closed position where the door covers the opening and an open position where the door does not cover the opening, and electrical components for powering and operating the light source mounted to the door and disposed in the service compartment when the door is in the closed position. The hinge assembly includes, an asymmetric pin extending from one of the housing and the door, a cavity formed in the other of the housing and the door having a hinge opening of width W, wherein the asymmetric pin has a cross sectional thickness t in one direction and a cross sectional height h in a direction orthogonal to the one direction, and wherein width W is less than height h and greater than thickness t such that the pin is removable from the cavity through the hinge opening when the door is in a removal position where the pin thickness t is aligned to the hinge opening width W.

Other objects and features of the present invention will become apparent by a review of the specification, claims and appended figures.

DETAILED DESCRIPTION OF THE INVENTION

Figure 1:
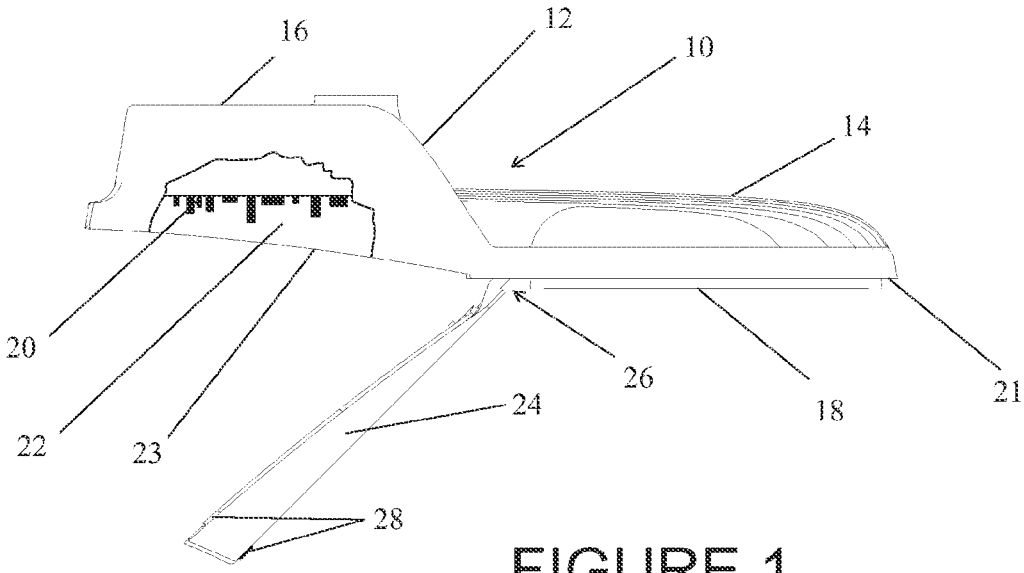
FIG. 1 is a partially broken away side view of the luminaire with the rotating and removable door in a partially open position.
Figure 2:
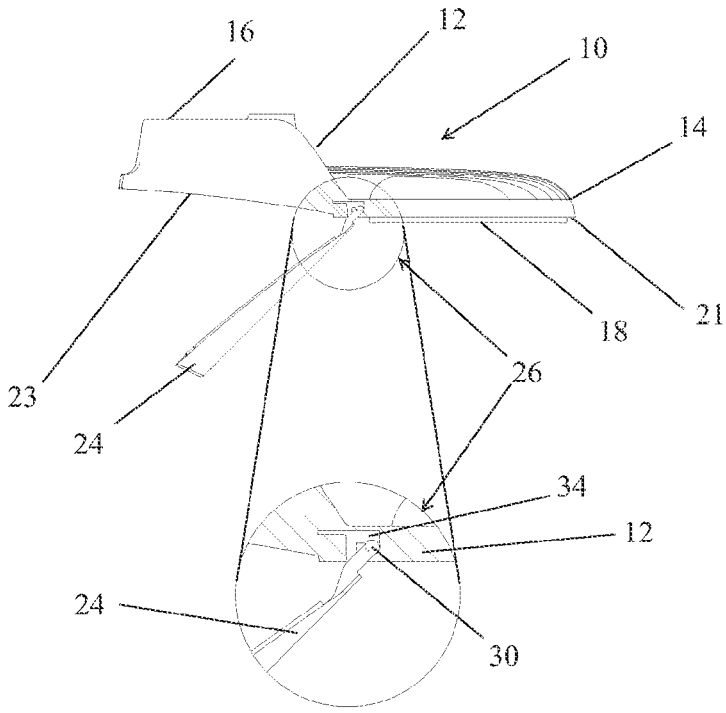
FIG. 2 is a side view with an expanded cross sectional view of the luminaire with the rotating and removable door in a partially open position.
Figure 3:
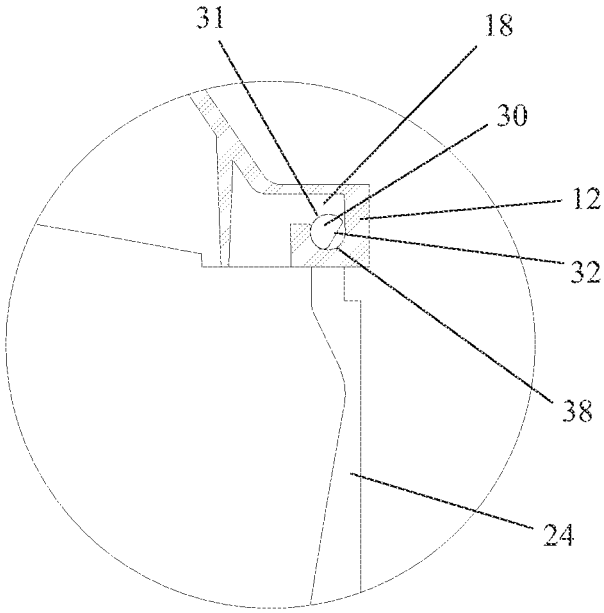
FIG. 3 is a partial cross-sectional view of the luminaire illustrating the hinge assembly with the door in an open position.

The luminaire 10 of the present invention is illustrated in FIGS. 1-9, and includes a housing 12 (with a first portion 14 and a second portion 16), a light source 18, and supporting electrical components 20 for powering and operating the light source 18.

The housing first portion 14 is concave with a light output opening 21 facing downwardly. The light source 18 is at least partially disposed in housing first portion 14, and directs its light output downwardly through or from the light output opening 21. An optional lens or transparent cover (not shown) could be included to seal closed the light output opening end 21 and protect the light source 18.

The housing second portion 16 forms a service compartment 22 in which the supporting electrical components 20 and any other serviceable components are disposed. The service compartment 22 includes a service opening 23 which is covered by a door 24. Door 24 is rotationally and removably connected to the housing 12 by a hinge assembly 26. The unhinged end of the door 24 removably attaches to the housing 12 via a latch 28 to keep the door 24 in its closed position. Latch 28 can be a bolt or a screw, but preferably is a sliding or rotating latch mechanism that can be operated by hand (without the aid of a tool).

Figure 4:
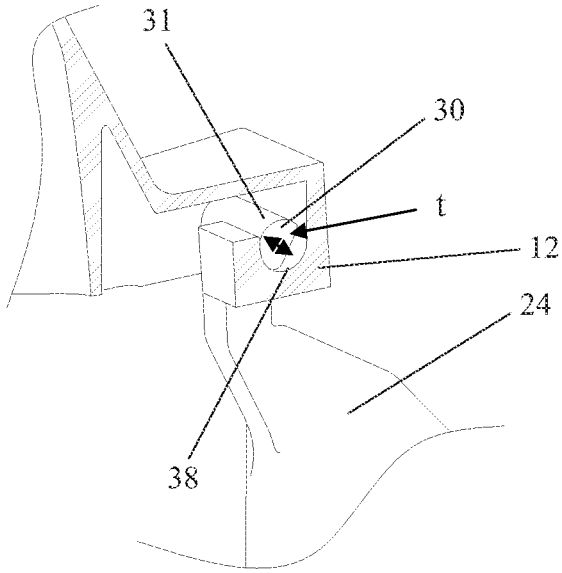
FIGS. 4-6 are partial elevated cross-sectional views of the luminaire illustrating the hinge assembly with the door in an open position.
Figure 5:
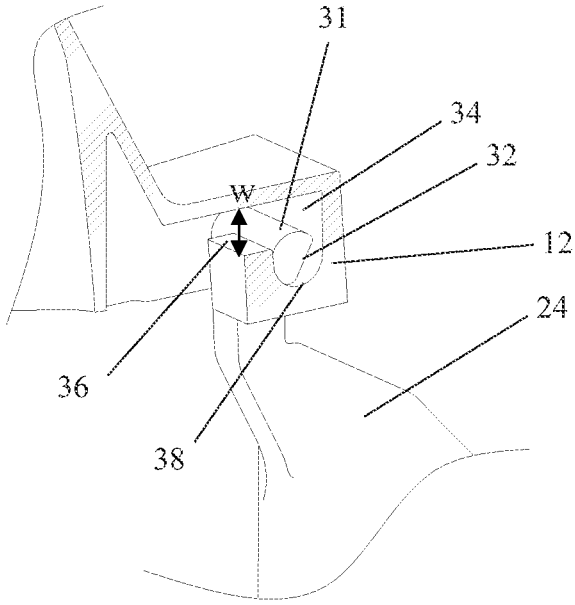
Figure 6:
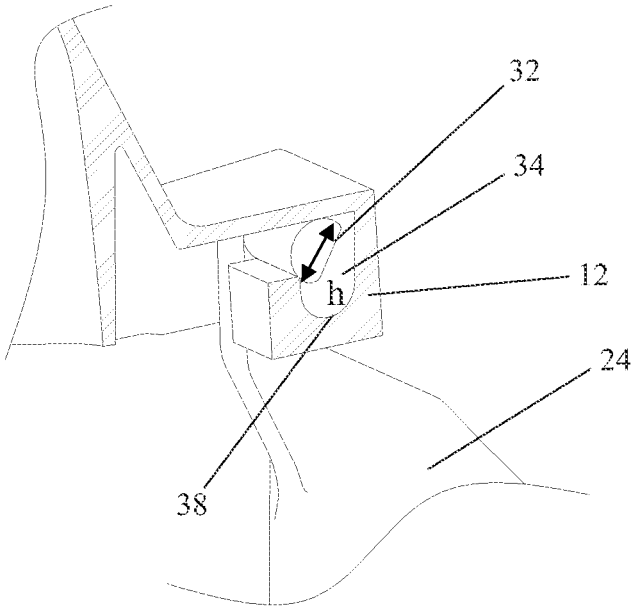

The hinge assembly 26 is better illustrated in FIGS. 2-8. The door 24 terminates in a round pin 30 having a round outer surface 31 with a diameter or height h, best illustrated in FIG. 6. The pin 30, however, includes a flat face 32 formed into one side of the round outer surface 31, so that the pin 30 has a reduced diameter or thickness t in one direction, as best illustrated in FIG. 4. A cavity 34 is formed in the housing 12 of sufficient size to accommodate the pin 30. The cavity 34 has a hinge opening 36 of reduced width W, and terminates with a rounded hinge surface 38, as best illustrated in FIG. 5.

Figure 7:
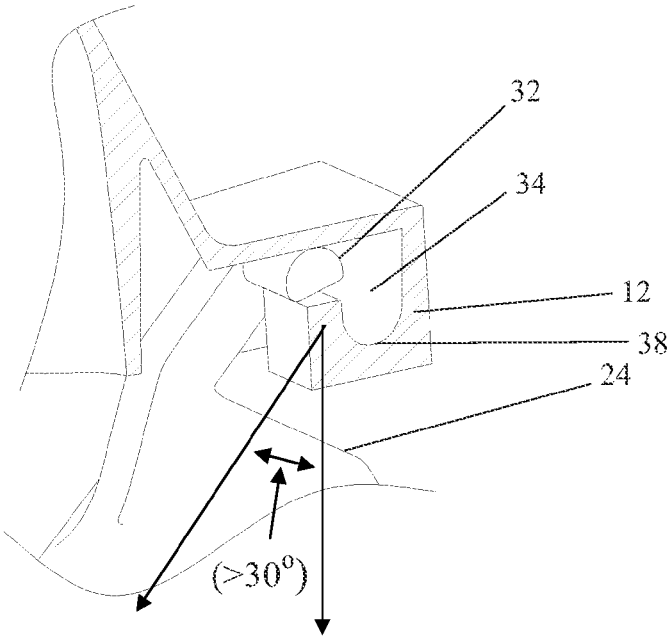
FIG. 7 is a partial elevated cross-sectional view of the luminaire illustrating the hinge assembly with the door in an intermediary position for door removal.
Figure 8:
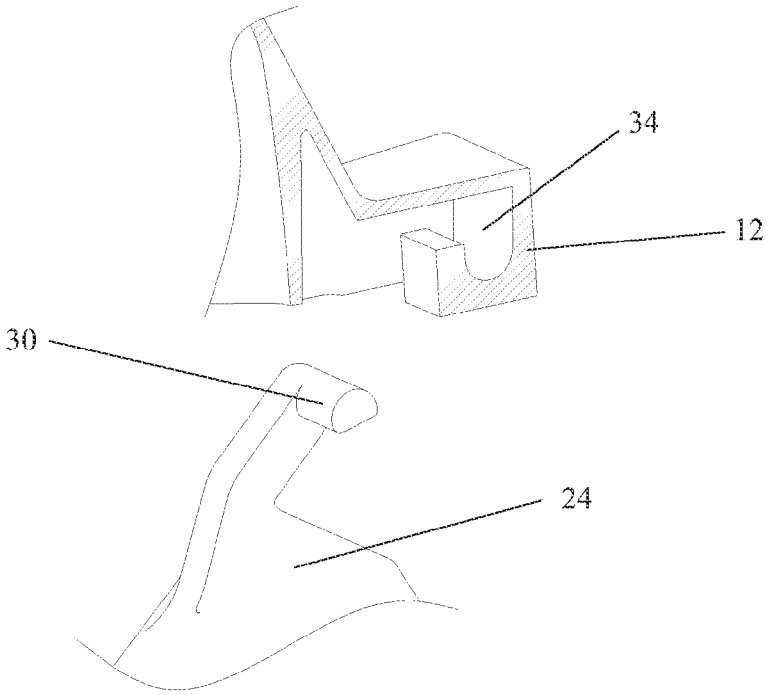
FIG. 8 is a partial elevated cross-sectional view of the luminaire with the door removed from the housing.
Figure 9:
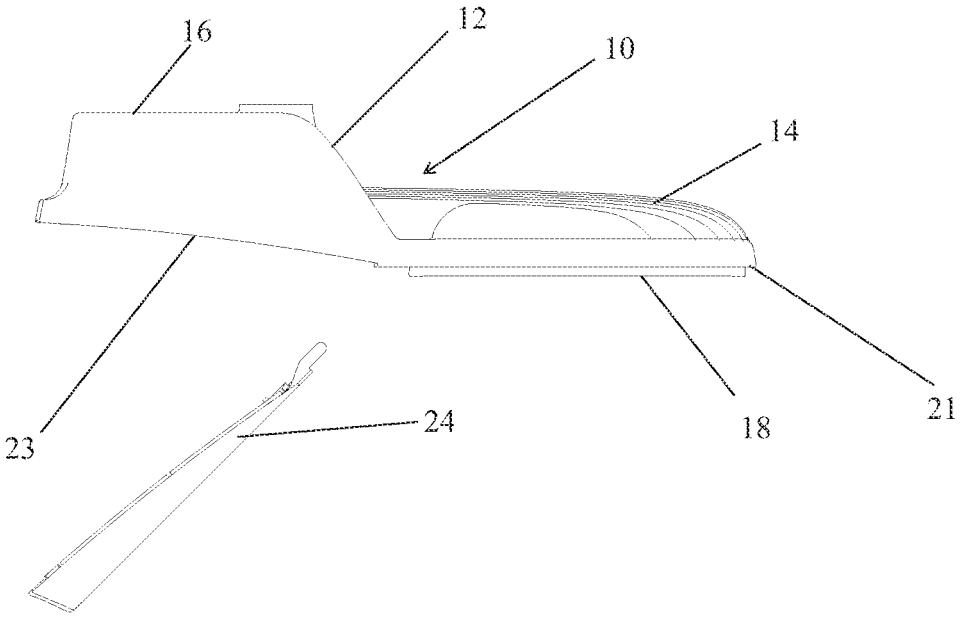
FIG. 9 is a side view of the luminaire with the door removed from the housing.

The width W of hinge opening 36 is smaller than the diameter/height h of pin 30, but larger than reduced diameter/thickness t. Therefore, in most rotational positions, the pin 30 is maintained inside cavity 34 because the pin 30 will not fit through hinge opening 36 (see FIG. 5). Preferably, for smooth operation, the radius of curvature of the pin round outer surface 31 matches that of the rounded hinge surface 38. When the reduced thickness t of pin 30 is aligned to the width w of hinge opening 36 (i.e. at a range of angles that define the door removal position), the pin 30 will fit through hinge opening 36 and can be removed from housing 12. The flat face 32 of pin 30 is therefore preferably oriented such that the pin 30 is maintained in cavity 34 when the door is closed (covering service opening 23) and when the door is in its open position (hanging vertically down, see FIGS. 3-6), as well as any other positions except for the intermediary door removal position. When the door is positioned in an intermediary door removal position (e.g. preferably around 30 degrees or greater from its vertical open position so the door in its open vertical position will not fall off, as illustrated in FIGS. 7-8), or instead a position beyond the open position, the door can be removed from and reconnected to housing 12 because flat face 32 of pin 30 is generally aligned with one of the surfaces forming opening 36 so that pin 30 will fit through opening 36.

With the above described configuration, the service compartment 22 can be quickly and conveniently accessed by operating the latch 28 and allowing the door 24 to swing down under the force of gravity. If greater access is desired, then the door can be rotated to the door removal position (to align reduced pin thickness t with opening width W), whereby pin 30 can pass through hinge opening 36 so that door 24 can be removed from housing 12. It should be noted that while only one hinge assembly 26 is shown and described, multiple hinge assemblies (i.e. multiples pins 30 engaged with multiple cavities 34) could be used to removably secure door 24 to housing 12.

Figure 10:
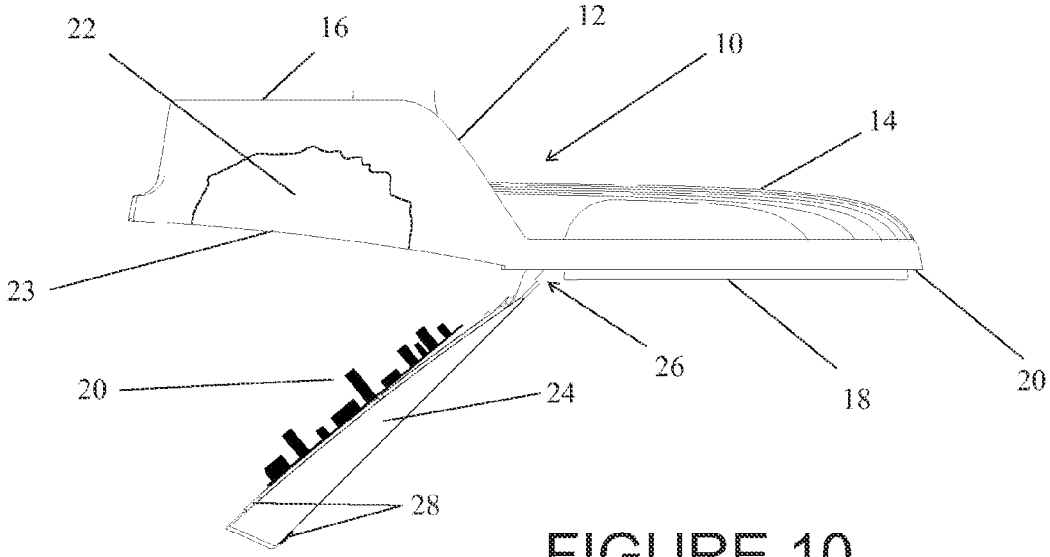
FIG. 10 is a partially broken away side view of an alternate embodiment of the luminaire, with electrical components secured to the door.

FIG. 10 illustrates an alternate embodiment of the present invention, where the electrical components 20 are mounted to the door 24. Not only does this configuration allow for easier access to the electrical components 20, but it allows for a more convenient configuration for replacing the electrical components should they fail. To replace the electrical components 20, one would simply have to open and replace the removable door 24 as described above.

It is to be understood that the present invention is not limited to the embodiment(s) described above and illustrated herein, but encompasses any and all variations falling within the scope of the appended claims. For example, references to the present invention herein are not intended to limit the scope of any claim or claim term, but instead merely make reference to one or more features that may be covered by one or more of the claims. While pin 30 is shown with a generally round cross section having a flat face formed on one side, pin 30 can be any non-symmetrical shape where it has a larger cross sectional diameter or thickness t in one direction than in an orthogonal direction to define a range of angles in which the door can be removed (i.e. the door removal position). While the door is shown to include the pin 30 and the housing is shown to include the cavity 34, the opposite can be true (i.e. the housing can include the pin 30 and the door can include the cavity 34).

What is claimed is:

1. A luminaire, comprising:

a housing with a service compartment therein that is accessible through an opening in the housing;

a light source at least partially disposed in the housing for producing a light output;

electrical components disposed in the service compartment for powering and operating the light source; and a door that is rotatably connected via a hinge assembly to the housing for rotation between a closed position where the door covers the opening and an open position where the door does not cover the opening;

the hinge assembly includes:

an asymmetric pin extending from one of the housing and the door, a cavity formed in the other of the housing and the door having a hinge opening of width W, wherein the asymmetric pin has a cross sectional thickness t in one direction and a cross sectional height h in a direction orthogonal to the one direction, and wherein width W is less than height h and greater than thickness t such that the pin is removable from the cavity through the hinge opening when the door is in a removal position where the pin thickness t is aligned to the hinge opening width W.

2. The luminaire of claim 1, wherein the pin extends from the door and the cavity is formed in the housing.

3. The luminaire of claim 1, wherein the pin has a round outer surface with a flat face formed therein.

4. The luminaire of claim 3, wherein the cavity terminates in a rounded surface that has a radius of curvature that matches that of the round outer surface of the pin.

5. The luminaire of claim 1, wherein the open position is at least 90 degrees from the closed position.

6. The luminaire of claim 5, wherein the removal position is between the open position and the closed position.

7. The luminaire of claim 6, wherein the removal position is at least 30 degrees away from the open position.

8. The luminaire of claim 5, wherein the removal position is not between the open position and the closed position.

9. A luminaire, comprising:

a housing with a service compartment therein that is accessible through an opening in the housing;

a light source at least partially disposed in the housing for producing a light output;

a door that is rotatably connected via a hinge assembly to the housing for rotation between a closed position where the door covers the opening and an open position where the door does not cover the opening; and electrical components for powering and operating the light source mounted to the door and disposed in the service compartment when the door is in the closed position;

the hinge assembly includes:

an asymmetric pin extending from one of the housing and the door, a cavity formed in the other of the housing and the door having a hinge opening of width W, wherein the asymmetric pin has a cross sectional thickness t in one direction and a cross sectional height h in a direction orthogonal to the one direction, and wherein width W is less than height h and greater than thickness t such that the pin is removable from the cavity through the hinge opening when the door is in a removal position where the pin thickness t is aligned to the hinge opening width W.

10. The luminaire of claim 9, wherein the pin extends from the door and the cavity is formed in the housing.

11. The luminaire of claim 9, wherein the pin has a round outer surface with a flat face formed therein.

12. The luminaire of claim 11, wherein the cavity terminates in a rounded surface that has a radius of curvature that matches that of the round outer surface of the pin.

13. The luminaire of claim 9, wherein the open position is at least 90 degrees from the closed position.

14. The luminaire of claim 13, wherein the removal position is between the open position and the closed position.

15. The luminaire of claim 14, wherein the removal position is at least 30 degrees away from the open position.

16. The luminaire of claim 13, wherein the removal position is not between the open position and the closed position.

* * * * *